US009950514B2

(12) United States Patent
Nakayama et al.

(10) Patent No.: US 9,950,514 B2
(45) Date of Patent: Apr. 24, 2018

(54) PIEZOELECTRIC ELEMENT, LIQUID EJECTING HEAD, AND PIEZOELECTRIC ELEMENT DEVICE

(71) Applicant: Seiko Epson Corporation, Tokyo (JP)

(72) Inventors: Masao Nakayama, Shiojiri (JP); Eiju Hirai, Azumino (JP); Naoto Yokoyama, Matsumoto (JP); Motoki Takabe, Shiojiri (JP); Yoichi Naganuma, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/416,316

(22) Filed: Jan. 26, 2017

(65) Prior Publication Data

US 2017/0217180 A1 Aug. 3, 2017

(30) Foreign Application Priority Data

Feb. 3, 2016 (JP) ..... 2016-019289

(51) Int. Cl.
*B41J 2/14* (2006.01)
*B41J 2/01* (2006.01)

(52) U.S. Cl.
CPC ..... *B41J 2/01* (2013.01); *B41J 2/14201* (2013.01); *B41J 2/14233* (2013.01); *B41J 2002/1425* (2013.01)

(58) Field of Classification Search
CPC ..... B41J 2/01; B41J 2/14201; B41J 2/14233; B41J 2002/1425
See application file for complete search history.

(56) References Cited

U.S. PATENT DOCUMENTS 6,336,717 B1 * 1/2002 Shimada ..... B41J 2/14233 347/71
2009/0244206 A1 10/2009 Nakayama
2011/0234708 A1 * 9/2011 Nakayama ..... B41J 2/14233 347/70

FOREIGN PATENT DOCUMENTS

JP 2000-052550 A 2/2000
JP 2009-252757 A 10/2009

* cited by examiner

*Primary Examiner* — Yaovi M Ameh
(74) *Attorney, Agent, or Firm* — Harness, Dickey & Pierce, P.L.C.

(57) ABSTRACT

Provided are a vibrating plate, a first electrode provided over the vibrating plate, a piezoelectric layer provided over the first electrode, and a second electrode provided over the piezoelectric layer are provided. The piezoelectric layer is interposed between the first electrode and the second electrode. The piezoelectric layer includes an active portion of which at least one end portion is defined by the first electrode, and a non-active portion provided on an outside of the end portion of the first electrode for defining the active portion. The vibrating plate includes a first vibration portion under the non-active portion and a second vibration portion on an outside of the first vibration portion. The second vibration portion includes a taper part having the thickness which is increased toward the first vibration portion.

12 Claims, 8 Drawing Sheets

PIEZOELECTRIC ELEMENT, LIQUID EJECTING HEAD, AND PIEZOELECTRIC ELEMENT DEVICE

BACKGROUND

1. Technical Field

The present invention relates to a piezoelectric element which includes a first electrode, a piezoelectric layer, and a second electrode, a liquid ejecting head which includes the piezoelectric element, and a piezoelectric element device which includes the piezoelectric element.

2. Related Art

A liquid ejecting head in which a piezoelectric element is deformed to cause pressure to fluctuate in a liquid in a pressure generation chamber and thus causing droplets to be ejected from a nozzle opening which communicates with the pressure generation chamber is known. As a representative example of the liquid ejecting head, there is an ink jet type recording head that ejects an ink droplet as a droplet.

The ink jet type recording head includes, for example, a piezoelectric element on one surface side of a flow passage formation substrate in which a pressure generation chamber communicating with a nozzle opening is provided. A vibrating plate is deformed by driving the piezoelectric element, and thus pressure on an ink in the pressure generation chamber is changed, and an ink droplet is ejected from the nozzle opening.

In such a piezoelectric element, a structure is proposed in which the strength of a so-called arm which is a portion of a vibrating plate supporting a piezoelectric element when the piezoelectric element deforms the vibrating plate is improved (for example, see JP-A-2000-52550). Specifically, a beam portion is provided at a portion of the arm, the thickness of which is reduced in order to increase the displacement of the vibrating plate, and thus an improvement in strength is achieved.

However, forming a beam portion in the vicinity of an end portion of the piezoelectric element is not possible or is difficult. Thus, efficiently suppressing the piezoelectric element from being fractured by the stress concentration on the end portion may not be possible. Stress may be concentrated in the vicinity of an end portion at a non-active portion of the piezoelectric element, and thus the piezoelectric element may be fractured.

Such a problem is not limited to a piezoelectric element used in a liquid ejecting head such as an ink jet type recording head, and similarly occurs in a piezoelectric element used in other types of devices.

SUMMARY

An advantage of some aspects of the invention is that a piezoelectric element, a liquid ejecting head, and a piezoelectric element device which have improved reliability are provided.

According to an aspect of the invention, there is provided a piezoelectric element which includes a vibrating plate, a first electrode provided over the vibrating plate, a piezoelectric layer provided over the first electrode, and a second electrode provided over the piezoelectric layer. The piezoelectric layer is interposed between the first electrode and the second electrode. The piezoelectric layer includes an active portion of which at least one end portion is defined by the first electrode, and a non-active portion provided on an outside of the end portion of the first electrode for defining the active portion. The vibrating plate includes a first vibration portion under the non-active portion and a second vibration portion on an outside of the first vibration portion. The second vibration portion includes a taper part having the thickness which is increased toward the first vibration portion.

In the aspect, the second vibration portion of the vibrating plate under the non-active portion has a thickness which is increased toward the first vibration portion. That is, since the thickness of the vibrating plate becomes thicker in the vicinity of an end portion of the piezoelectric layer, on which stress is concentrated, it is possible to suppress an occurrence of fracture of the vibrating plate due to stress. The thickness of the second vibration portion is thinner than the first vibration portion. Thus, it is possible to increase displacement of the vibrating plate while the piezoelectric element is deformed. In such an aspect, there is provided a piezoelectric element in which reliability is improved and the vibrating plate has satisfactory displacement.

An inclination angle of a taper part of the second vibration portion, of which the thickness is increased toward the first vibration portion is preferably smaller than an inclination angle of a side surface of the piezoelectric layer. According to this, it is possible to release concentration of stress on the end portion of the piezoelectric layer, and to more suppress fracture of the vibrating plate.

The vibrating plate preferably includes a first layer on the first electrode side, and a second layer on a side of the first layer, which is opposite to the first electrode. The first layer preferably includes a part of which a thickness is increased toward the first vibration portion. According to this, it is possible to form the vibrating plate by using materials which are different from each other, for the first layer and the second layer. For example, the first layer is formed by using a material having high toughness, and thus it is possible to apply toughness to the first vibration portion which is thicker than the second vibration portion, and to more reliably suppress the occurrence of fracture of the vibrating plate.

The first electrode preferably includes a first film thickness portion under the active portion, and a second film thickness portion on an outside of the first film thickness portion. The second film thickness portion preferably includes a part of which a thickness is increased toward the first film thickness portion. According to this, the second film thickness portion of the first electrode under the active portion has a thickness which is increased toward the first film thickness portion. That is, since the thickness of the first electrode becomes thicker in the vicinity of an end portion of the piezoelectric layer, on which stress is concentrated, it is possible to suppress the occurrence of fracture of the first electrode due to stress. The thickness of the second film thickness portion is thinner than that of the first film thickness portion. Thus, it is difficult that the first electrode hinders the displacement of the vibrating plate with deforming the piezoelectric element. In such an aspect, there is provided a piezoelectric element in which reliability is improved and the vibrating plate has satisfactory displacement.

According to another aspect of the invention, there is provided a liquid ejecting head which includes the piezoelectric element described in the above aspect. According to this, the piezoelectric element in the above aspect is provided, and thus there is provided a liquid ejecting head which has improved reliability and satisfactory ejecting characteristics of a liquid.

According to still another aspect of the invention, there is provided a piezoelectric element device which includes the piezoelectric element described in the above aspect. According to this, there is provided a piezoelectric element device in which fracture of the vibrating plate is suppressed and reliability is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary Embodiment 1

Figure 1:
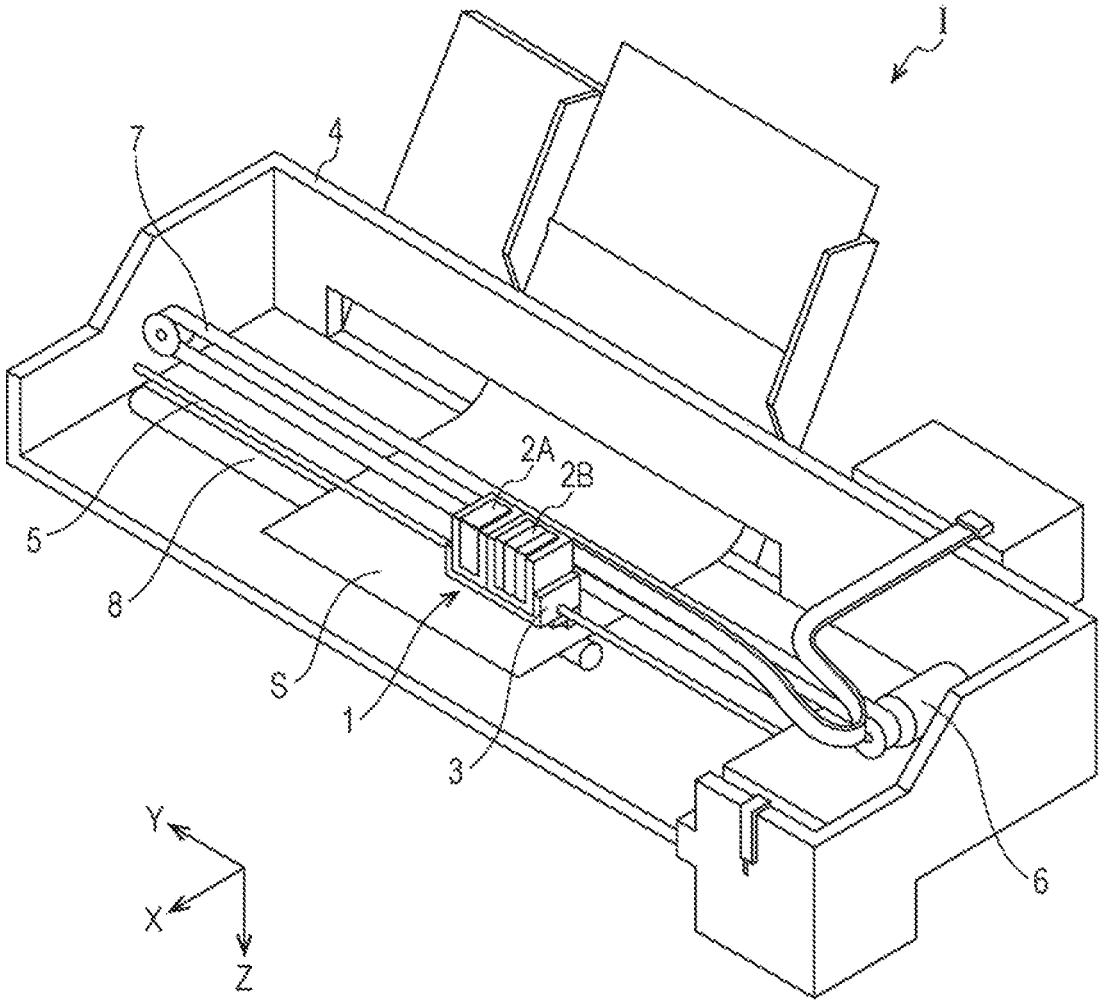
FIG. 1 is a perspective view illustrating a recording device.

FIG. 1 is a perspective view of an ink jet type recording device which is an example of a liquid ejecting apparatus according to an exemplary embodiment. An ink jet type recording head is an example of a liquid ejecting head, and is simply also referred to as a recording head.

An ink jet type recording device I includes a carriage shaft 5 attached to a device main body 4. A carriage 3 is provided on the carriage shaft 5 so as to be movable along an axis direction of the carriage shaft 5. A recording head 1 is provided in the carriage 3. A cartridge 2A and a cartridge 2B are provided in the carriage 3 so as to be attachable. The cartridge 2A and the cartridge 2B are each an example of an ink supply unit, and supply ink to the recording head 1.

A driving motor 6 is provided in the device main body 4. A driving force of the driving motor 6 is transferred to the carriage 3 via a plurality of gears and a timing belt 7 (not illustrated). Thus, the carriage 3 moves along the carriage shaft 5. A transporting roller 8 as a transporting unit is provided in the device main body 4. A recording sheet S which is a recording medium such as paper is transported by the transporting roller 8. The transporting unit is not limited to the transporting roller 8, and may be a belt, a drum, or the like.

In such an ink jet type recording device I, the carriage 3 moves along the carriage shaft 5 and ink is discharged by the recording head 1, and thus printing on a recording sheet S is performed.

In the exemplary embodiment, a direction in which the recording head 1 discharges an ink is defined as a Z-direction. A direction in which the carriage 3 performs reciprocation moving in a plane perpendicular to the Z-direction is defined as a Y-direction. A direction perpendicular to the Y-direction and the Z-direction is defined as an X-direction.

Figure 2:
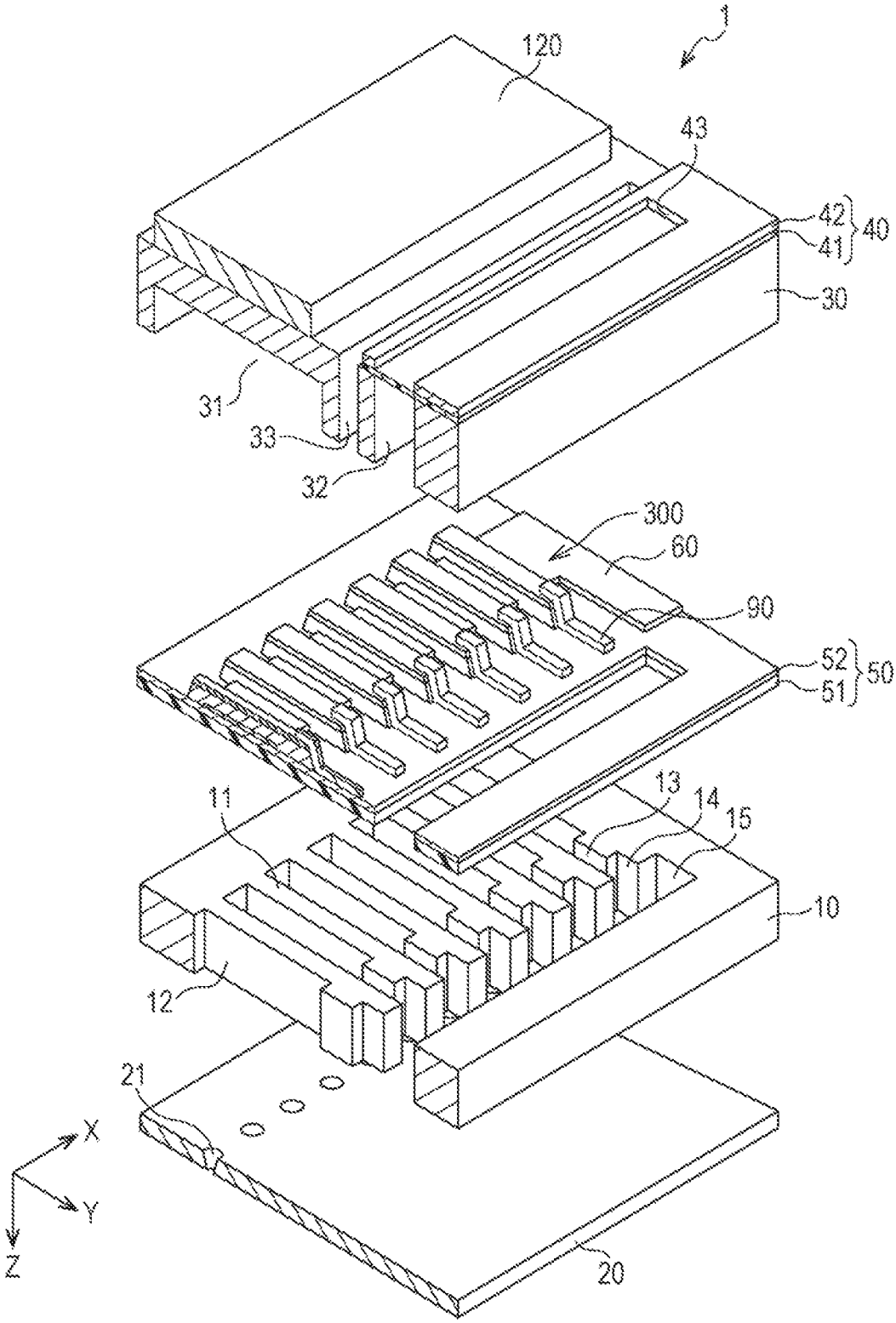
FIG. 2 is a perspective view illustrating a recording head.
Figure 3:
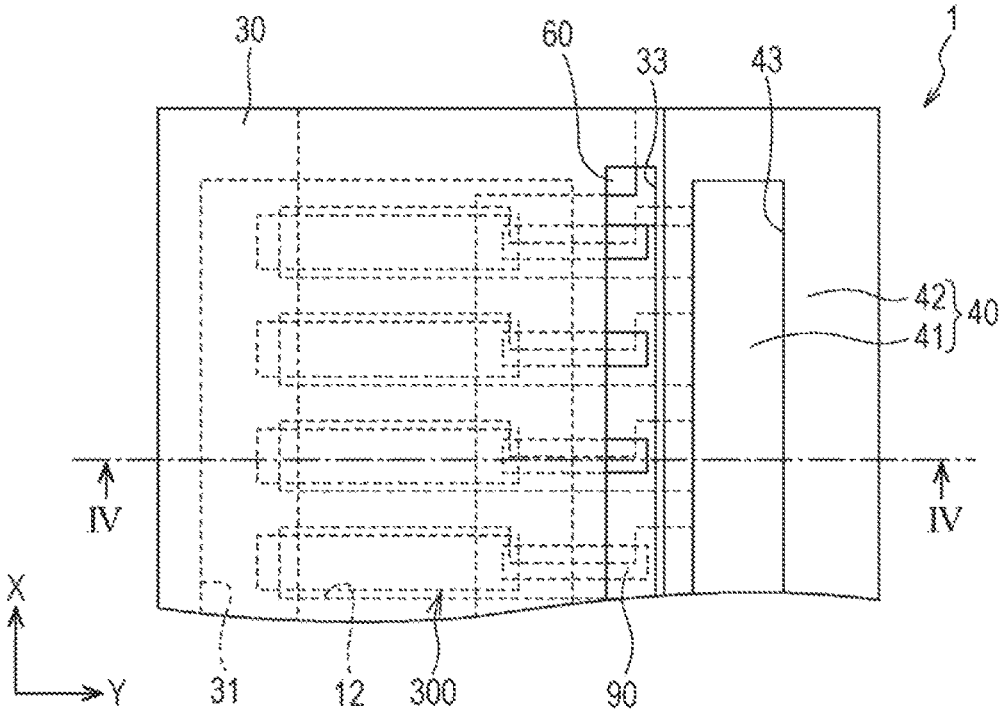
FIG. 3 is a plan view illustrating the recording head.
Figure 4:
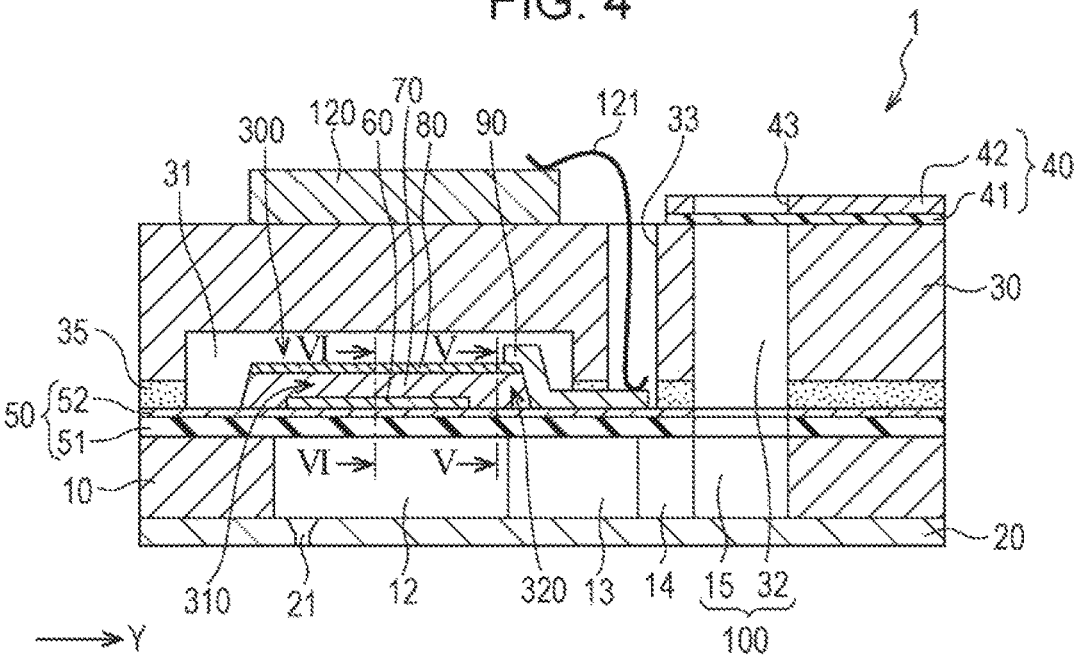
FIG. 4 is a sectional view taken along line IV-IV in FIG. 3.

FIG. 2 is a perspective view illustrating the recording head. FIG. 3 is a plan view illustrating the recording head. FIG. 4 is a sectional view taken along line IV-IV in FIG. 3.

The recording head 1 includes a flow passage formation substrate 10. Pressure generation chambers 12 subdivided by a plurality of partitions 11 are formed in the flow passage formation substrate 10. The pressure generation chambers 12 are arranged in a direction in which a plurality of nozzle openings 21 which discharges the same ink are arranged. This direction is referred to as an arrangement direction of the pressure generation chamber 12, or the X-direction below. The direction perpendicular to the X-direction is referred to as the Y-direction. The direction perpendicular to the X-direction and the Y-direction is referred to as the Z-direction. The Z-direction is a direction in which ink is discharged from the nozzle opening 21. In the exemplary embodiment, the directions (X, Y, and Z) have a relationship of being perpendicular to each other. However, the arrangement relationship between components is not necessarily limited to this.

Ink supply passages 13 and communicating passages are obtained by subdivision by the plurality of partitions 11. The ink supply passages 13 and the communicating passages 14 are provided on one end portion of the pressure generation chamber 12 of the flow passage formation substrate 10 in a longitudinal direction, that is, on one end portion thereof in the Y-direction. A communication portion 15 is formed on the outside of the communicating passage 14 (on an opposite side of the pressure generation chamber 12 in the Y-direction). The communication portion 15 functions as a common ink chamber (liquid chamber) for the pressure generation chambers 12, and constitutes a portion of a manifold 100. That is, a liquid flow passage constituted by the pressure generation chamber 12, the ink supply passage 13, the communicating passage 14, and the communication portion 15 is provided in the flow passage formation substrate 10.

A nozzle plate 20 is bonded to one surface side of the flow passage formation substrate 10, that is to a surface to which the liquid flow passage of the pressure generation chamber 12 and the like opens. The nozzle plate is bonded by an adhesive, a heat-welding film, or the like. Nozzle openings 21 are arranged in the nozzle plate 20 in the X-direction. The nozzle plate 20 is bonded to the flow passage formation substrate 10 so as to cause the nozzle openings 21 to communicate with the pressure generation chambers 12, respectively.

A vibrating plate 50 is formed on the other surface side of the flow passage formation substrate 10. The vibrating plate 50 according to the exemplary embodiment is a portion deformed by the piezoelectric element 300. The vibrating plate 50 is formed of an elastic film 51 and an insulating film 52. The elastic film 51 is formed on the flow passage formation substrate 10. The insulating film 52 is formed on the elastic film 51. The structure of the vibrating plate 50 will be described later in detail.

A piezoelectric element 300 formed of a first electrode 60, a piezoelectric layer 70, and a second electrode 80 is formed on the insulating film 52. In the exemplary embodiment, the flow passage formation substrate 10, the vibrating plate 50, and the piezoelectric element 300, which form the pressure generation chamber 12, functions as an actuator device which is an example of a piezoelectric device including a piezoelectric element.

The first electrode 60 constituting the piezoelectric element 300 is an electrode provided over the vibrating plate 50. In the exemplary embodiment, the first electrode 60 is continuously formed over the plurality of pressure generation chambers 12, and functions as a common electrode for a plurality of piezoelectric elements 300. A material which can maintain conductivity without being oxidized when the piezoelectric layer 70 (which will be described later) is formed is preferably used as a material of the first electrode 60. For example, a precious metal such as platinum (Pt) or iridium (Ir), or a conductive oxide represented by lanthanum nickel oxide (LNO) or the like is appropriately used.

An adhesive layer for ensuring an adhesive force may be provided between the first electrode 60 and the vibrating plate 50. That is, the first electrode 60 is not required to be directly provided on the surface of the vibrating plate 50. The first electrode 60 may be provided over the vibrating plate 50 via the adhesive layer. Zirconium, titanium, titanium oxide, and the like may be used for the adhesive layer.

The piezoelectric layer 70 is formed in such a manner that patterning is performed on each of the pressure generation chambers 12. The width of the piezoelectric layer 70 in the Y-direction is wider than the length of the pressure generation chamber 12 in the Y-direction. Thus, the piezoelectric layer 70 is provided up to the outside of the pressure generation chamber 12 in the Y-direction of the pressure generation chamber 12.

An end portion of the piezoelectric layer 70 on the ink supply passage 13 side is positioned on the outside of the end portion of the first electrode 60, in the Y-direction of the pressure generation chamber 12. That is, an end portion of the first electrode 60 is covered by the piezoelectric layer 70. An end portion of the piezoelectric layer 70 on the nozzle opening 21 is positioned on the outside of the end portion of the first electrode 60. An end portion of the first electrode 60 on the nozzle opening 21 side is covered by the piezoelectric layer 70.

The piezoelectric layer 70 is a crystalline film (perovskite-type crystal) which is formed of a ferroelectric ceramic material exhibiting an electromechanical conversion action, and has a perovskite structure. As a material of the piezoelectric layer 70, for example, a ferroelectric piezoelectric material such as lead zirconate titanate (PZT) and a substance obtained by adding metal oxide (such as niobium oxide, nickel oxide, or magnesium oxide) to the ferroelectric piezoelectric material may be used. The material of the piezoelectric layer 70 is not limited to a lead type piezoelectric material which contains lead. As the material of the piezoelectric layer 70, a non-lead type piezoelectric material which does not contain lead may be used.

The second electrode 80 is provided on a side of the piezoelectric layer 70 which is opposite to the first electrode 60. The second electrode 80 constitutes an individual electrode provided in each of a plurality of active portions 310. The second electrode 80 may be provided over the piezoelectric layer 70 or may be provided directly on the piezoelectric layer 70. Another member may be interposed between the second electrode 80 and the piezoelectric layer 70.

A material which can form a good interface with the piezoelectric layer 70 or can exhibit insulating characteristics and piezoelectric characteristics is desirably used for the second electrode 80. A precious metal material such as iridium (Ir), platinum (Pt), palladium (Pd), or gold (Au), or a conductive oxide which is represented by lanthanum nickel oxide (LNO) is appropriately used. The second electrode 80 may be a multilayer obtained by using plural types of materials.

In such a piezoelectric element 300 formed of the first electrode 60, the piezoelectric layer 70, and the second electrode 80, a voltage is applied between the first electrode 60 and the second electrode 80, and thus displacement occurs. That is, a voltage is applied between both of the electrodes, and thus piezoelectric strain occurs in the piezoelectric layer 70 interposed between the first electrode 60 and the second electrode 80. When a voltage is applied between both of the electrodes, a portion of the piezoelectric layer 70 at which piezoelectric strain occurs is referred to as an active portion 310. In contrast, a portion of the piezoelectric layer 70 at which the piezoelectric strain does not occur is referred to as a non-active portion 320. An end portion of the active portion 310 in the X-direction is defined by the second electrode 80. An end portion of the active portion 310 in the Y-direction is defined by the first electrode 60.

A lead electrode 90 is connected to a portion of the first electrode 60 in the piezoelectric element 300, which is drawn to the outside of the piezoelectric layer 70. A lead electrode (not particularly illustrated) is also connected to the second electrode 80 in the piezoelectric element 300.

A protective substrate 30 for protecting the piezoelectric element 300 is bonded onto the flow passage formation substrate 10 on which such a piezoelectric element 300 is formed, by using an adhesive 35. A piezoelectric element holding portion 31 is provided in the protective substrate 30. The piezoelectric element holding portion 31 is a recess portion which forms a space for accommodating the piezoelectric element 300.

A manifold portion 32 which constitutes a portion of the manifold 100 is provided in the protective substrate 30. The manifold portion 32 is formed over a width direction of the pressure generation chamber 12 by penetrating the protective substrate 30 in a thickness direction. As described above, the manifold portion 32 communicates with the communication portion 15 of the flow passage formation substrate 10, so as to form the manifold 100.

A through hole 33 which penetrates the protective substrate 30 in the thickness direction is provided in the protective substrate 30. The lead electrode 90 connected to each of the first electrodes 60, and the lead electrode (not illustrated) connected to the second electrode 80 are exposed in the through hole 33.

A drive circuit 120 for driving the piezoelectric element 300 is provided on the protective substrate 30. The drive circuit 120 may use, for example, a circuit board, and a semiconductor integrated circuit (IC). The drive circuit 120, the lead electrode 90, and the lead electrode connected to the second electrode 80 are electrically connected to each other through connection wiring 121 which is inserted into the through hole 33. Although not illustrated, the drive circuit 120 is connected to a control device configured to control an operation of the ink jet type recording device I. The drive circuit 120 drives the piezoelectric element 300 in accordance with a signal from the control device.

A compliance board 40 formed of a sealing film 41 and a fixation plate 42 is bonded onto the protective substrate 30. The sealing film 41 is formed of a material having plasticity and low rigidity. One surface of the manifold portion 32 is sealed by the sealing film 41. The fixation plate 42 is formed of a hard material such as metal. A region of the fixation plate 42, which faces the manifold 100 functions as an opening portion 43 which has been completely removed in the thickness direction. Thus, the one surface of the manifold 100 is sealed only by the sealing film 41 having plasticity.

In such a recording head 1 in the exemplary embodiment, ink is poured from the external cartridge 2A and cartridge 2B (see FIG. 1), and the inside from the manifold 100 to the nozzle opening 21 is filled with the ink. Then, a voltage is applied between the first electrode 60 and the second electrode 80 which correspond to the pressure generation chamber 12, in accordance with a signal from the drive circuit 120. The applied voltage causes the vibrating plate 50 along with the piezoelectric element 300 to be flexibly deformed. Thus, pressure in each of the pressure generation chambers 12 becomes higher, and an ink droplet is ejected from each of the nozzle openings 21.

Figure 5:
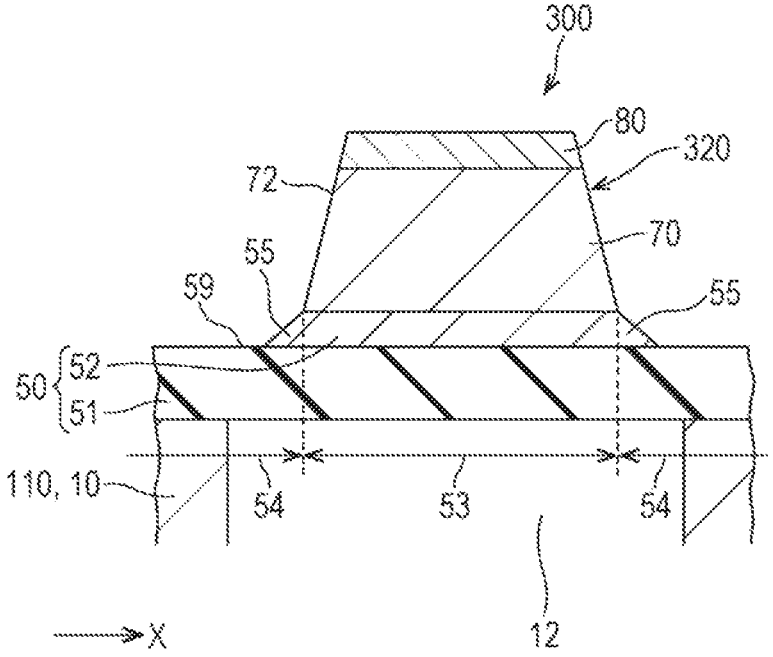
FIG. 5 is a sectional view taken along line V-V in FIG. 4.
Figure 6:
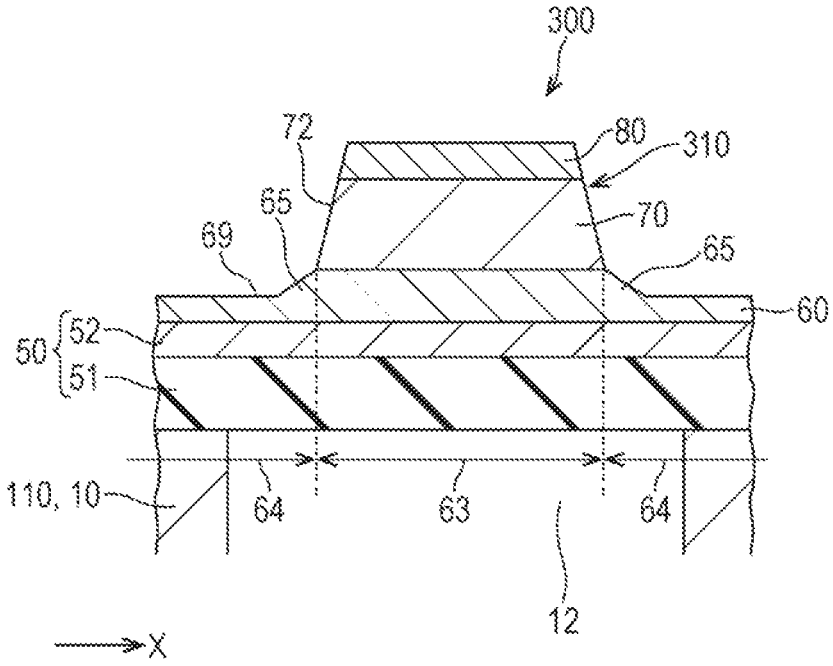
FIG. 6 is a sectional view taken along line VI-VI in FIG. 4.

Here, the configuration of the piezoelectric element 300 will be described in detail, with reference to FIGS. 4 to 6. FIG. 5 is a sectional view taken along line V-V in FIG. 4. FIG. 6 is a sectional view taken along line VI-VI in FIG. 4. The section taken along line V-V in FIG. 5 is a transverse section of sectioning the non-active portion of the piezoelectric element along the X-direction. The section taken along line VI-VI in FIG. 6 is a transverse section of sectioning the active portion of the piezoelectric element along the X-direction.

As illustrated in FIGS. 4 and 5, the piezoelectric element 300 includes the non-active portion 320. The non-active portion 320 is a portion of the piezoelectric layer 70 constituting the piezoelectric element 300, which is not interposed between the first electrode 60 and the second electrode 80. In the exemplary embodiment, both of the end portions of the piezoelectric layer 70 in the Y-direction are provided so as to extend to the outside of both of the end portions of the first electrode 60 in the Y-direction, and are formed on the vibrating plate 50. That is, both of the end portions of the piezoelectric layer 70 in the Y-direction are not provided on the first electrode 60. Both of the end portions correspond to the non-active portion 320 which is not interposed between the first electrode 60 and the second electrode 80.

The vibrating plate 50 includes a first vibration portion 53 under the above-described non-active portion 320, and a second vibration portion 54 on the outside of the first vibration portion 53.

The first vibration portion 53 is a portion of the vibrating plate 50, which is positioned under the non-active portion 320 of the piezoelectric layer 70 (on the first electrode 60 side when viewed from the piezoelectric element 300). In other words, the first vibration portion 53 is a portion of the vibrating plate 50, which overlaps the non-active portion 320 of the piezoelectric layer 70. In the exemplary embodiment, a portion of the elastic film 51 and the insulating film 52, which is positioned under the piezoelectric layer 70 corresponds to the first vibration portion 53. In the first vibration portion 53, the elastic film 51 and the insulating film 52 have a thickness which is substantially uniform. As in the exemplary embodiment, the first vibration portion 53 is not limited to a case of being in contact with a lower surface side of the piezoelectric layer 70. The first vibration portion 53 may be indirectly positioned under the piezoelectric layer 70 by interposing another member between the first vibration portion 53 and the piezoelectric layer 70.

The second vibration portion 54 is a portion of the vibrating plate 50, which is on the outside of the first vibration portion 53. In other words, the second vibration portion 54 is a portion of the vibrating plate 50, which does not overlap the piezoelectric layer 70. In the exemplary embodiment, the elastic film 51 and the insulating film 52 on the outside of the first vibration portion 53 in the X-direction correspond to the second vibration portion 54.

The second vibration portion 54 as described above includes a part which has the thickness of which slightly increases toward the first vibration portion 53. The part at which the thickness of the second vibration portion 54 slightly increases is referred to as a taper part 55. In the exemplary embodiment, the taper part 55 having the thickness which is slightly increased toward the first vibration portion 53 is provided in the insulating film 52. An outer portion of the insulating film 52 is removed from the taper part 55. The elastic film 51 has a part which is not covered by the insulating film 52. The elastic film 51 has a thickness which is substantially uniform. A portion of the elastic film 51, which is not covered by the insulating film 52, and constitutes the pressure generation chamber 12, functions as an arm 59.

As described above, the vibrating plate 50 includes the first vibration portion 53 and the second vibration portion 54, and the second vibration portion 54 includes the taper part 55 and the arm 59. The first vibration portion 53 and the second vibration portion 54 constitute an upper surface of the pressure generation chamber 12, and cause displacement to occur with deformation of the piezoelectric element 300. Thus, the first vibration portion 53 and the second vibration portion 54 function as a portion at which pressure change is caused to occur in the pressure generation chamber 12.

The vibrating plate 50 includes the second vibration portion 54 which includes the above-described taper part 55. Thus, the vibrating plate 50 has a thickness which increases toward the end portion of the piezoelectric layer 70, and decreases away from the piezoelectric layer 70 and toward the partition 11.

In the piezoelectric element 300 having such a configuration, the non-active portion 320 is a portion which is different from the active portion 310, and is not deformed. The vibrating plate 50 causes displacement with deformation of the active portion 310. The displacement of the vibrating plate 50 causes displacement to also occur in the first vibration portion 53 and the second vibration portion 54 under the non-active portion 320. The displacement causes stress to be concentrated in the vicinity of a boundary between the first vibration portion 53 and the second vibration portion 54 under the non-active portion 320 of the piezoelectric layer 70.

In the piezoelectric element 300 in the exemplary embodiment, the taper part 55 is provided in the vicinity of the boundary between the first vibration portion 53 and the second vibration portion 54, on which stress is concentrated. The taper part 55 causes the second vibration portion 54 to have a thickness which increases toward the first vibration portion 53, and causes the second vibration portion 54 to be reinforced against the stress. Thus, it is possible to suppress the occurrence of fracture of the vibrating plate 50 due to stress, under the non-active portion 320 of the piezoelectric layer 70.

The thickness of the second vibration portion 54 is smaller than that of the first vibration portion 53 at a portion on the outside (arm 59) of the taper part 55. Thus, it is possible to increase the quantity of displacement of the vibrating plate 50 with deformation of the piezoelectric element 300.

As described above, according to the exemplary embodiment, there is provided the piezoelectric element 300 in which the second vibration portion 54 having the thickness which is slightly increased toward the first vibration portion 53 is provided, and thus an occurrence of fracture of the vibrating plate 50 (first vibration portion and second vibration portion) positioned under the non-active portion 320 is suppressed, reliability is improved, and satisfactory displacement is obtained. In addition, there is provided the recording head 1 in which such a piezoelectric element 300 is provided, and thus reliability is improved, and ejecting characteristics of ink are satisfactory.

The inclination angle of the taper part 55 is smaller than the inclination angle of a side surface 72 of the piezoelectric layer 70. The inclination angle of the taper part 55 refers to an angle of an inclined surface of the taper part 55, by using the surface of the elastic film in the vibrating plate 50 as a reference. The inclination angle of the side surface 72 of the piezoelectric layer 70 refers to an angle of the side surface 72 by using the surface of the first electrode 60 on which the piezoelectric layer 70 is provided, as a reference.

The taper part 55 and the side surface 72 of the piezoelectric layer 70 has an inclination angle as described above. With such a configuration, it is possible to form a gentle inclination over the taper part 55 from the side surface 72 of the piezoelectric layer 70. Thus, it is possible to release concentration of stress on the end portion of the piezoelectric layer 70, and to furthermore suppress the occurrence of fracture of the vibrating plate 50.

In the exemplary embodiment, among the elastic film (second layer in claims) and the insulating film 52 (first layer in claims) constituting the vibrating plate 50, the taper part 55 is provided in the insulating film 52, and the elastic film 51 is set to have a thickness which is substantially uniform. That is, only the insulating film 52 as the first layer includes the taper part 55 having the thickness which is slightly increased toward the first vibration portion 53. The insulating film 52 including such a taper part 55 is preferably formed of zirconium oxide having high toughness.

In the piezoelectric element 300 having such a configuration, the vibrating plate 50 may be formed by using materials for the elastic film 51 and the insulating film 52, which are separate from each other. In the exemplary embodiment, the insulating film 52 is formed of zirconium oxide having high toughness. Thus, it is possible to more reliably suppress the vibrating plate 50 from being fractured due to stress concentration, by the film thickness of the taper part 55 and the toughness of the material.

Generally, it is known that zirconium oxide has a relatively large Young's modulus. The arm 59 is not covered by the insulating film 52. Thus, since displacement of the arm 59 is not suppressed by the insulating film 52, it is possible to increase the amount of displacement of the vibrating plate 50. The insulating film 52 is not limited to a case of being formed of zirconium oxide.

As illustrated in FIGS. 4 and 6, the piezoelectric element 300 includes the active portion 310. The active portion 310 is a portion of the piezoelectric layer 70 constituting the piezoelectric element 300, which is interposed between the first electrode 60 and the second electrode 80. The active portion 310 is a portion at which piezoelectric strain occurs by applying a voltage to the first electrode 60 and the second electrode 80. The piezoelectric strain causes the first electrode 60, the insulating film 52, and the elastic film 51 to be bent in the width direction (X-direction) of the piezoelectric element 300.

The first electrode 60 includes a first film thickness portion 63 under the above-described active portion 310, and a second film thickness portion 64 on the outside of the first film thickness portion 63.

The first film thickness portion 63 is a portion of the first electrode 60, which is positioned under the active portion 310 of the piezoelectric layer 70 (on the first electrode 60 side when viewed from the piezoelectric element 300). In other words, the first film thickness portion 63 is a portion of the first electrode 60, which overlaps the active portion 310 of the piezoelectric layer 70. The thickness is substantially uniform at the first film thickness portion 63. As in the exemplary embodiment, the first film thickness portion 63 is not limited to a case of being in contact with a lower surface side of the piezoelectric layer 70. The first film thickness portion 63 may be indirectly positioned under the piezoelectric layer 70 by interposing another member such as an adhesive layer, between the first film thickness portion 63 and the piezoelectric layer 70.

The second film thickness portion 64 is a portion of the first electrode 60, which is positioned on the outside of the first film thickness portion 63. In other words, the second film thickness portion 64 is a portion of the first electrode 60, which does not overlap the piezoelectric layer 70.

Such a second film thickness portion 64 includes a part having the thickness which is slightly increased toward the first film thickness portion 63. The part at which the thickness of the second film thickness portion 64 is slightly increased is referred to as a taper part 65. A part of the second film thickness portion 64 other than the taper part 65 is referred to as an arm 69. The arm 69 faces the pressure generation chamber 12.

As described above, the first electrode 60 includes the first film thickness portion 63 and the second film thickness portion 64, and the second film thickness portion 64 includes the taper part 65 and the arm 69. The above-described taper part 65 is provided, and thus the first electrode 60 has a thickness which increases toward the end portion of the piezoelectric layer 70, and decreases away from the piezoelectric layer 70 and toward the partition 11.

In the piezoelectric element 300 having such a configuration, the first electrode 60 causes displacement with deformation of the active portion 310. The displacement of the first electrode 60 causes stress to be concentrated in the vicinity of a boundary between the first film thickness portion 63 and the second film thickness portion 64, under the active portion 310 of the piezoelectric layer 70.

In the piezoelectric element 300 according to the exemplary embodiment, the taper part 65 is provided in the vicinity of a boundary between the first film thickness portion 63 and the second film thickness portion 64, where stress is concentrated. The taper part 65 causes the second film thickness portion 64 to have a thickness which increases toward the first film thickness portion 63, and causes the second film thickness portion 64 to be reinforced against the stress. Thus, it is possible to suppress the occurrence of fracture of the first electrode 60 due to stress, under the active portion 310 of the piezoelectric layer 70.

The thickness of the second film thickness portion 64 is smaller than that of the first film thickness portion 63 at a portion of on the outside (arm 69) of the taper part 65. Thus, it is difficult for the first electrode 60 to hinder the displacement of the vibrating plate 50 with deformation of the piezoelectric element 300.

As described above, according to the exemplary embodiment, there is provided the piezoelectric element 300 in which the second film thickness portion 64 having the thickness which is slightly increased toward the first film thickness portion 63 is provided, and thus an occurrence of fracture of the first electrode 60 positioned under the active portion 310 is suppressed, reliability is improved, and satisfactory displacement is obtained. In addition, there is provided the recording head 1 in which such a piezoelectric element 300 is provided, and thus reliability is improved, and ejecting characteristics of ink is satisfactory.

A method of manufacturing a recording head, which includes a method of manufacturing the piezoelectric element according to the exemplary embodiment will be described. FIGS. 7 to 12 are sectional views illustrating the method of manufacturing the piezoelectric element and the recording head. A section passing through the active portion 310 of the piezoelectric element 300 is illustrated on the left side, and a section passing through the non-active portion 320 of the piezoelectric element 300 is illustrated on the right side in each of the drawings.

Figure 7:
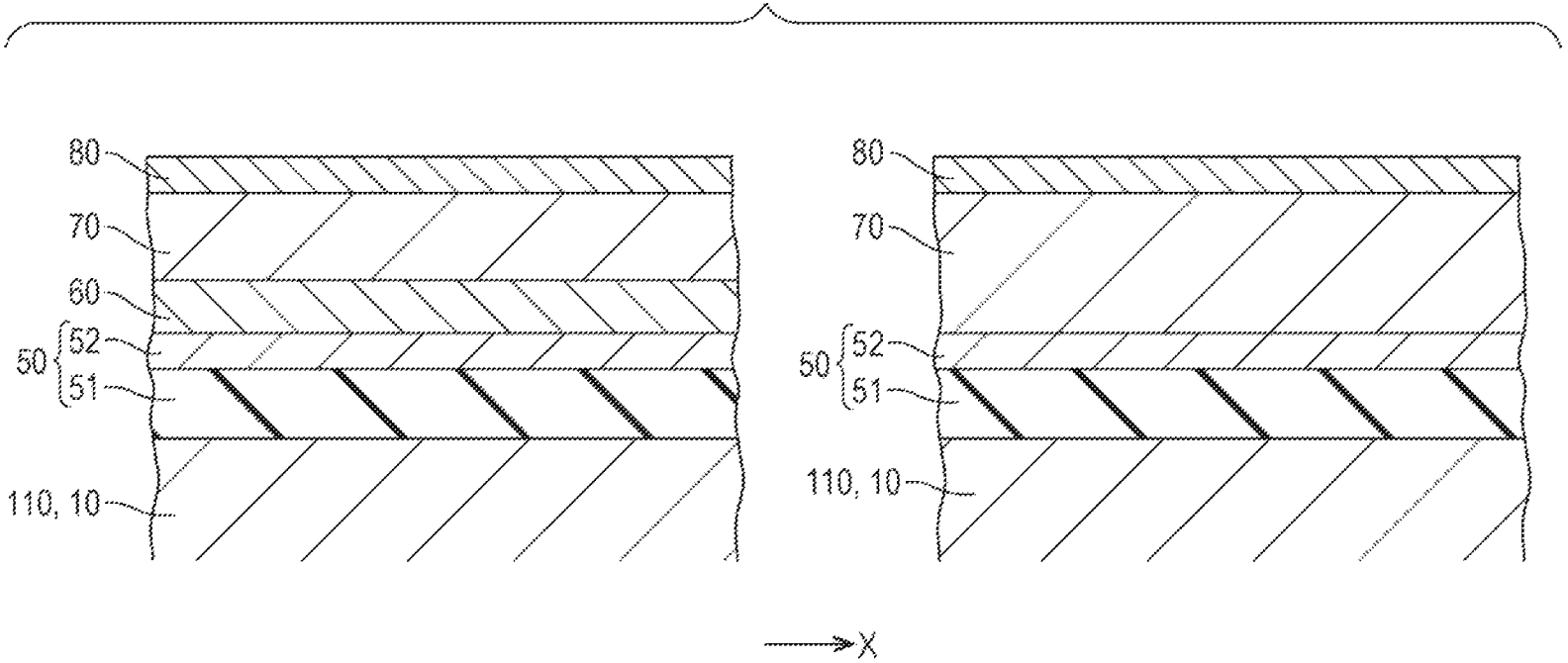
FIG. 7 is a sectional view illustrating a method of manufacturing a piezoelectric element and the recording head.

As illustrated in FIG. 7, a vibrating plate 50 is formed on the surface of a wafer 110 for a flow passage formation substrate. The wafer 110 is a silicon wafer on which a plurality of flow passage formation substrates 10 are integrally formed. In the exemplary embodiment, the vibrating plate 50 formed from a multilayer is formed. The multilayer is formed of silicon dioxide (elastic film 51) formed by thermal-oxidizing the wafer 110 for a flow passage formation substrate, and zirconium oxide (insulating film 52) formed in such a manner that a film is formed by a sputtering method, and then is thermal-oxidized.

Then, a first electrode 60 is formed on the entire surface of the insulating film 52. A region indicating the active portion 310 is illustrated on the left side in FIG. 7, and thus the first electrode 60 is provided. A region indicating the non-active portion 320 is illustrated on the right side in FIG. 7, and thus the first electrode 60 is not provided. The material of the first electrode 60 is not particularly limited. For example, a metal such as platinum or iridium, which does not lose conductivity even at a high temperature, a conductive oxide such as iridium oxide or lanthanum nickel oxide, and a multilayer material of these materials are appropriately used. The first electrode 60 may be formed, for example, by a vapor phase film formation such as a sputtering method, a PVD method (physical vapor deposition method), or a laser ablation method, or liquid phase film formation such as a spin coating method.

Then, a piezoelectric layer 70 is formed. In the exemplary embodiment, a plurality of piezoelectric films formed of lead zirconate titanate (PZT) are stacked, and thus the piezoelectric layer 70 is formed. The piezoelectric layer 70 may be formed by a so-called sol-gel method. In the sol-gel method, so-called sol obtained by dissolving and dispersing metal complex in a solvent is applied and dried so as to obtain a gel, and the obtained gel is baked at a high temperature so as to obtain the piezoelectric layer 70 formed of metal oxide. The method of manufacturing the piezoelectric layer 70 is not limited to the sol-gel method. For example, a metal-organic decomposition (MOD) method, a sputtering method, a physical vapor deposition (PVD) method such as a laser ablation method, or the like may be used. That is, the piezoelectric layer 70 may be formed by any of a liquid phase method and a vapor phase method.

Then, a second electrode 80 is formed on the piezoelectric layer 70. The second electrode 80 may be formed by a sputtering method, a physical vapor deposition (PVD) method (vapor phase method) such as a laser ablation method, a sol-gel method, a metal-organic decomposition (MOD) method, and a liquid phase method such as a plating method.

Figure 8:
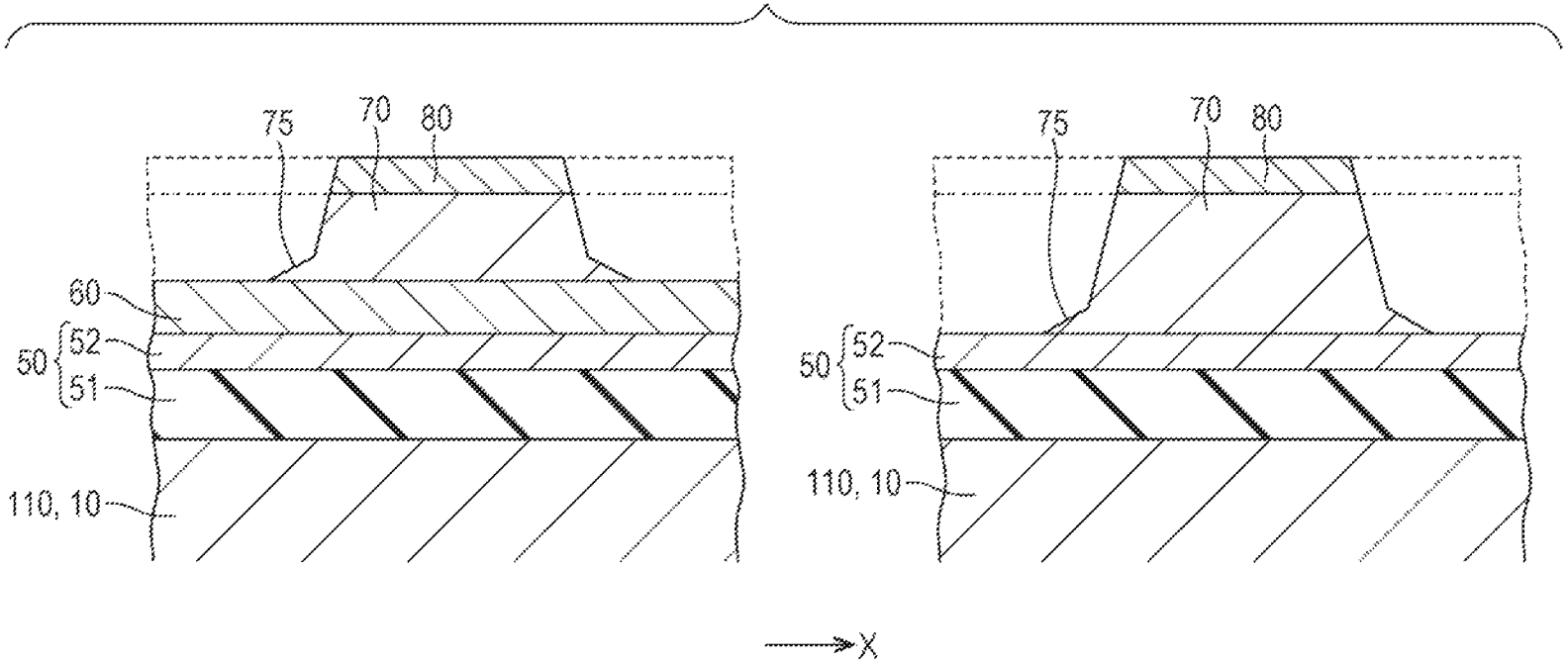
FIG. 8 is a sectional view illustrating the method of manufacturing the piezoelectric element and the recording head.

Then, as illustrated in FIG. 8, a resist (not illustrated) is formed on the second electrode 80, and the second electrode 80 and the piezoelectric layer 70 are patterned. Patterning may be performed, for example, by dry etching. Dry etching is preferably performed, for example, at pressure of 1.0 Pa or less by using an etching device which uses high-density plasma such as inductively coupled plasma (ICP). As an etching gas, for example, a gas mixture of a chlorine-based gas and a fluorocarbon-based gas may be used. Examples of the chlorine-based gas include $BCl_3$ and $Cl_2$. Examples of the fluorocarbon-based gas include $CF_4$ and $C_2F_6$.

A μ loading effect of dry etching causes a taper part 75 to be formed in the piezoelectric layer 70. The taper part 75 has a thickness which becomes thinner toward a direction of being far from a resist pattern. The μ loading effect refers a phenomenon in which a local difference of pattern density causes an etching rate or shape to be changed. In the exemplary embodiment, an etching gas is insufficiently supplied in the vicinity of the resist pattern, and thus the etching rate becomes slow. As being far from the resist pattern, the etching gas is easily supplied, and the etching rate becomes fast.

Figure 9:
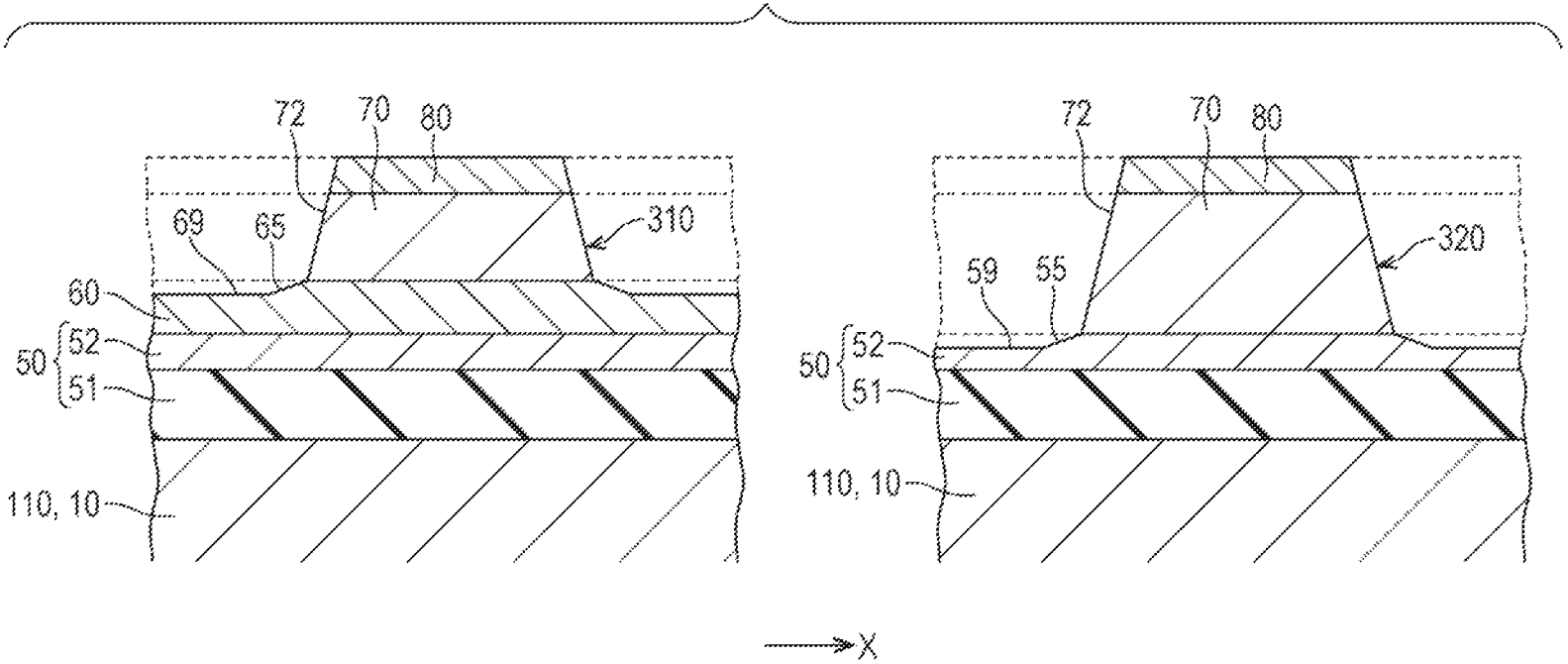
FIG. 9 is a sectional view illustrating the method of manufacturing the piezoelectric element and the recording head.

As illustrated in FIG. 9, dry etching is continuously performed on the piezoelectric layer 70. Thus, the first electrode 60 is patterned at the active portion 310, and the vibrating plate 50 is patterned at the non-active portion 320.

The active portion 310 includes the taper part 65 having a thick thickness, in the vicinity of the end portion of the piezoelectric layer 70. Forming an arm 69 having a thin thickness is started at a portion far from the piezoelectric layer 70.

The non-active portion 320 includes the taper part having a thick thickness in the vicinity of the end portion of the piezoelectric layer 70. Forming an arm 59 at which the vibrating plate 50 has a thin thickness is started at a portion far from the piezoelectric layer 70.

As illustrated in FIGS. 5 and 6, dry etching is continuously performed, and thus the active portion 310 may include the taper part 65 having a thick thickness in the vicinity of the end portion of the piezoelectric layer 70, and an arm 69 having the thickness which becomes thin may be formed at a portion far from the piezoelectric layer 70.

The non-active portion 320 may include the taper part 55 having a thick thickness in the vicinity of the end portion of the piezoelectric layer 70, and an arm 59 obtained by removing the insulating film 52 may be formed at a portion far from the piezoelectric layer 70.

Then, although not illustrated, a wiring layer formed of a material which is used for forming a lead electrode 90 is formed over the entirety of one surface of the wafer 110 for a flow passage formation substrate. The wiring layer is patterned so as to have a predetermined shape, thereby forming the lead electrode 90.

Figure 10:
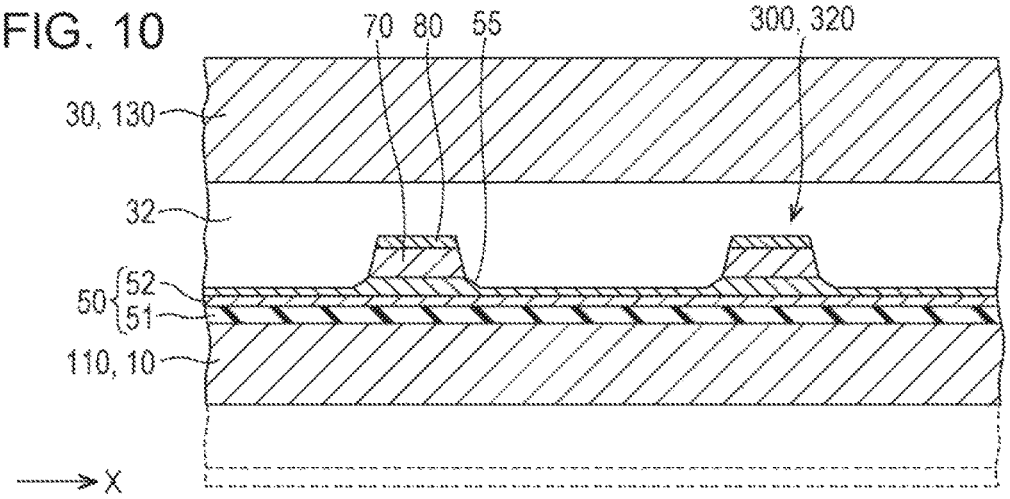
FIG. 10 is a sectional view illustrating the method of manufacturing the piezoelectric element and the recording head.

As illustrated in FIG. 10, a wafer 130 for a protective substrate which is a silicon wafer and forms a plurality of protective substrates 30 is bonded onto the piezoelectric element 300 side of the wafer 110 for a flow passage formation substrate, by using an adhesive. Then, the wafer 110 for a flow passage formation substrate is thinned so as to have a predetermined thickness.

Figure 11:
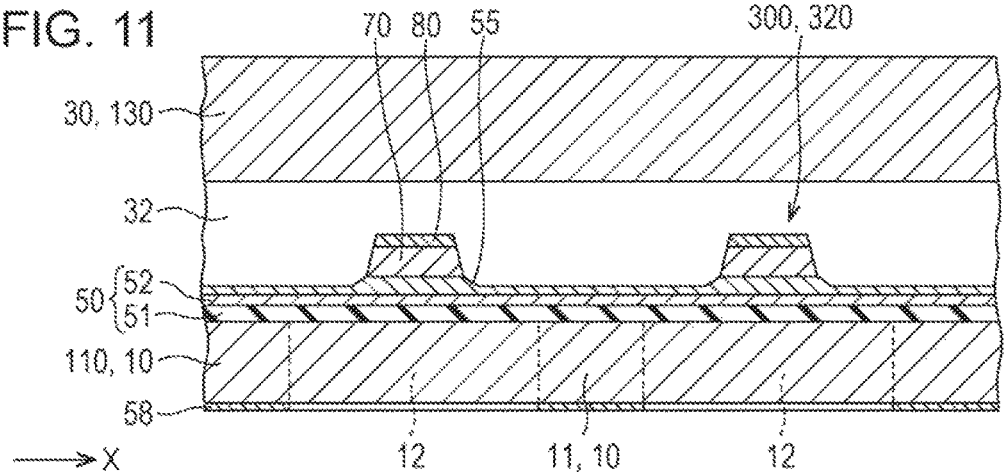
FIG. 11 is a sectional view illustrating the method of manufacturing the piezoelectric element and the recording head.
Figure 12:
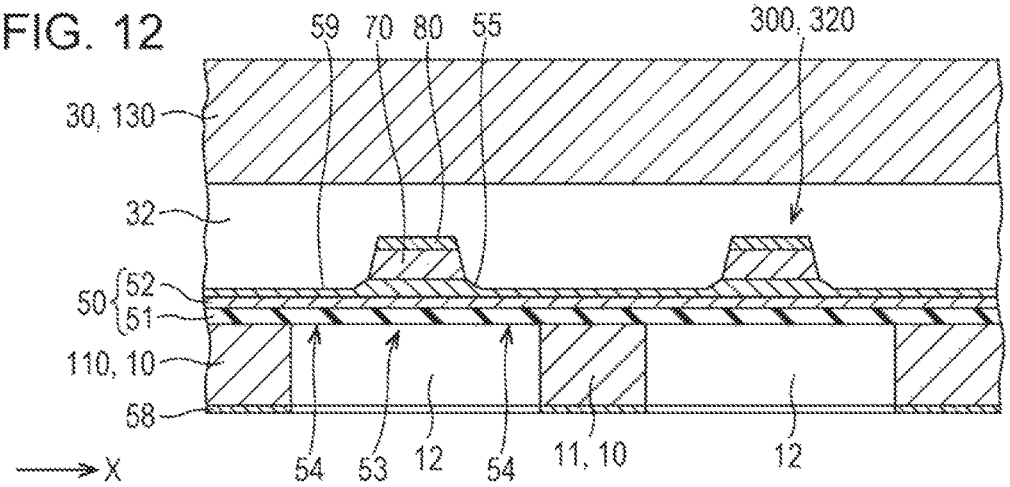
FIG. 12 is a sectional view illustrating the method manufacturing of the piezoelectric element and the recording head.

Then, as illustrated in FIG. 11, a mask film 58 is formed on the wafer 110 for a flow passage formation substrate, and is patterned so as to have a predetermined shape. As illustrated in FIG. 12, the wafer 110 for a flow passage formation substrate is subjected to anisotropic etching (wet etching) with an alkaline solution such as KOH, through the mask film 58. Thus, a pressure generation chamber 12, an ink supply passage 13, a communicating passage 14, a communication portion 15, and the like which correspond to the piezoelectric element 300 are formed (see FIG. 4).

Then, an unnecessary portion at an outer circumferential edge of the wafer 110 for a flow passage formation substrate and the wafer 130 for a protective substrate is cut out by, for example, dicing, and is removed. A nozzle plate 20 in which nozzle openings 21 are bored is bonded onto a surface of the wafer 110 for a flow passage formation substrate on an opposite side of the wafer 130 for a protective substrate, and a compliance board 40 is bonded to the wafer 130 for a protective substrate. The wafer 110 for a flow passage formation substrate is divided into flow passage formation substrates 10 of which each has one chip size as illustrated in FIG. 2, and thus the recording head 1 in the exemplary embodiment is obtained.

According to the above-described method of manufacturing the piezoelectric element in the exemplary embodiment, it is possible to manufacture a piezoelectric element 300 in which the second vibration portion 54 having the thickness which is slightly increased toward the first vibration portion 53 is provided, and thus the occurrence of fracture of the vibrating plate 50 due to stress is suppressed, reliability is improved, and satisfactory displacement is also obtained, under the non-active portion 320 of the piezoelectric element 300. In addition, it is possible to manufacture a recording head 1 which includes such a piezoelectric element 300 and has high reliability.

Another Exemplary Embodiment

Hitherto, the exemplary embodiment of the invention is described. However, the basic configuration of the exemplary embodiment according to the invention is not limited to the above descriptions.

For example, in above-described Exemplary Embodiment 1, the second vibration portion 54 includes the taper part 55 as a shape having the thickness which is slightly increased toward the first vibration portion 53. However, the second vibration portion 54 is not limited thereto. For example, the second vibration portion 54 may include a portion having the thickness which is slightly increased toward the first vibration portion 53, so as to have a curved shape which protrudes upwardly or downwardly in a view of the section in FIG. 5.

The vibrating plate 50 has a thickness which is substantially uniform, under the active portion 310 illustrated in FIG. 6. However, it is not limited thereto. For example, the first vibration portion 53 and the second vibration portion 54 may be formed under the active portion 310, similarly to the vibrating plate 50 under the non-active portion 320.

In Exemplary Embodiment 1, the inclination angle of the taper part 55 is smaller than the inclination angle of the side surface 72 of the piezoelectric layer 70. However, it is not limited thereto. That is, the inclination angle of the taper part 55 may be larger than the inclination angle of the side surface 72 of the piezoelectric layer 70. Even in a case of having such a shape, the inclination of the taper part 55 causes the thickness of the end portion of the piezoelectric layer 70 to become thicker. Thus, it is possible to suppress the occurrence of fracture of the vibrating plate 50. Regarding the taper part 65 of the first electrode 60, the above descriptions are similarly applied.

In Exemplary Embodiment 1, the elastic film 51 is not covered by the insulating film 52, on the outside of the taper part 55. However, it is not limited to such an aspect. For example, the insulating film 52 may cover the elastic film 51. For example, the taper part 55 may be provided in the insulating film 52. The insulating film 52 which is thinner than the first vibration portion 53 may remain on the outside of the taper part 55, and thus the insulating film 52 may cover the elastic film 51. The vibrating plate 50 is formed of two layers of the elastic film 51 and the insulating film 52. However, the vibrating plate 50 is not limited thereto. The vibrating plate 50 may be formed of a single layer, or three layers or more.

In Exemplary Embodiment 1, the first electrode 60 includes the taper part 65 as a shape having the thickness which is slightly increased toward the first film thickness portion 63. However, the first electrode 60 is not limited thereto. The second film thickness portion 64 may include a portion having the thickness which is slightly increased toward the first film thickness portion 63, so as to have a curved shape which protrudes upwardly or downwardly in a view of the section in FIG. 6. The taper part 65 may not be provided in the first electrode 60. The first electrode may have a substantially constant thickness.

In Exemplary Embodiment 1, a case where the recording head 1 is mounted in the carriage 3 and moves in a main scanning direction is described as an example of the ink jet type recording device I. However, this configuration is not particularly limited. For example, the ink jet type recording device I may be a so-called a line type recording device in which the recording head 1 is fixed, and a recording sheet S such as paper is moved in a sub-scanning direction so as to perform printing.

The ink jet type recording device I has a configuration in which the cartridge 2A and the cartridge 2B which are liquid storage units are mounted in the carriage 3. However, the ink jet type recording device I is not particularly limited thereto. For example, a liquid storage unit such as an ink tank may be fixed to the device main body 4, and the liquid storage unit and the recording head 1 may be connected to each other through a supply tube. The liquid storage unit may not be mounted in the ink jet type recording device I.

In the above exemplary embodiment, the ink jet type recording head as an example of the liquid ejecting head, and the ink jet type recording device as an example of the liquid ejecting apparatus are described. However, the exemplary embodiment of the invention widely sets the whole of the liquid ejecting head and the liquid ejecting apparatus as a target, and may be also applied to a liquid ejecting head or a liquid ejecting apparatus that ejects a liquid other than an ink. Examples of other liquid ejecting heads include various recording heads used in an image recording device such as a printer; a colorant ejecting head used in manufacturing a color filter in a liquid crystal display and the like; an electrode material ejecting head used when an electrode in an organic EL display, a field emission display (FED), and the like is formed; and a bio-organic substance ejecting head used in manufacturing a bio-chip. The above exemplary embodiment may be also applied to a liquid ejecting apparatus including the above-described liquid ejecting head.

The piezoelectric element according to the exemplary embodiment of the invention is not limited to a piezoactuator mounted in a liquid ejecting head which is represented by an ink jet type recording head. The piezoelectric element may be also applied to other piezoelectric devices, for example, an ultrasonic device such as an ultrasonic wave transmitter, an ultrasonic motor, a pressure sensor, and a current collecting sensor. In such a piezoelectric element device, the occurrence of fracture of a vibrating plate is also suppressed, and reliability is also improved.

The entire disclosure of Japanese Patent Application No. 2016-019289, filed Feb. 3, 2016 is expressly incorporated by reference herein in its entirety.

What is claimed is:

1. A piezoelectric element comprising:

a vibrating plate;

a first electrode provided on the vibrating plate;

a piezoelectric layer provided on the first electrode and the vibrating plate, the piezoelectric layer extending in a first direction; and a second electrode provided on the piezoelectric layer, wherein the piezoelectric layer includes an active portion and a non-active portion located directly next to the active portion, the piezoelectric layer in the active portion is directly provided between the first electrode and the second electrode, and the piezoelectric layer in the non-active portion is directly provided between the vibrating plate and the second electrode, the vibrating plate includes a first vibration portion at the non-active portion and a second vibration portion located directly adjacent to the first vibration portion, the second vibration portion has a first taper part, and a thickness of the second vibration portion increases toward the first vibration portion in the first taper part, and the first taper part extends in a second direction perpendicular to the first direction.

2. The piezoelectric element according to claim 1, wherein the piezoelectric layer has a second taper part at a side there of, a first inclination angle of the first taper part of the second vibration portion is smaller than a second inclination angle of the second taper part of the piezoelectric layer, and the second taper part extends in a second direction perpendicular to the first direction.

3. The piezoelectric element according to claim 1, wherein the vibrating plate is configured of a stacked layer in which a first layer and a second layer are stacked, a top surface of the first layer is directly contacted to a bottom surface of the first electrode in the active portion of the piezoelectric layer, and the first layer includes the first taper part in the non-active portion of the piezoelectric layer.

4. The piezoelectric element according to claim 1, wherein the first electrode includes a first film thickness portion under the active portion, a second film thickness portion on an outside of the first film thickness portion, and a connection film thickness portion continuously provided between the first and second film thickness portions, a thickness of the first film thickness portion is larger than a thickness of the second film thickness portion, a thickness of the connection film thickness portion increases toward the first film thickness portion from the second film thickness portion, and the connection film thickness portion extends in a second direction perpendicular to the first direction.

5. A liquid ejecting head comprising:

a plurality of nozzles configured to eject liquid; and the piezoelectric element according to claim 1.

6. A liquid ejecting head comprising:

a plurality of nozzles configured to elect liquid; and the piezoelectric element according to claim 2.

7. A liquid ejecting head comprising:

a plurality of nozzles configured to eject liquid; and the piezoelectric element according to claim 3.

8. A liquid ejecting head comprising:

a plurality of nozzles configured to eject liquid; and the piezoelectric element according to claim 4.

9. A piezoelectric element device comprising:

a flow passage formation substrate having a pressure generation chamber; and the piezoelectric element according to claim 1, wherein the piezoelectric layer and the pressure generation chamber are overlapped with each other in a plan view.

10. A piezoelectric element device comprising:

a flow passage formation substrate having a pressure generation chamber; and the piezoelectric element according to claim 2, wherein the piezoelectric layer and the pressure generation chamber are overlapped with each other in a plan view.

11. A piezoelectric element device comprising:

a flow passage formation substrate having a pressure generation chamber; and the piezoelectric element according to claim 3, wherein the piezoelectric layer and the pressure generation chamber are overlapped with each other in a plan view.

12. A piezoelectric element device comprising:

a flow passage formation substrate having a pressure generation chamber; and the piezoelectric element according to claim 4, wherein the piezoelectric layer and the pressure generation chamber are overlapped with each other in a plan view.

* * * * *